US006708696B2

(12) United States Patent
Ferguson

(10) Patent No.: US 6,708,696 B2
(45) Date of Patent: Mar. 23, 2004

(54) HAIRPIECE AND METHOD FOR ATTACHMENT

(76) Inventor: Rhona B. Ferguson, 119 SW. Carter Ave., Port St. Lucie, FL (US) 34983

( * ) Notice: Subject to any disclaimer, the term of this patent is extended or adjusted under 35 U.S.C. 154(b) by 201 days.

(21) Appl. No.: 10/083,115

(22) Filed: Feb. 27, 2002

(65) Prior Publication Data

US 2003/0159705 A1 Aug. 28, 2003

(51) Int. Cl.[7] ..... A41G 3/00
(52) U.S. Cl. ..... 132/53; 132/201
(58) Field of Search ..... 132/201, 53, 54, 132/56

(56) References Cited

U.S. PATENT DOCUMENTS 3,280,826 A * 10/1966 Jenkins ..... 132/53
4,372,330 A * 2/1983 Nelson ..... 132/53
5,775,341 A * 7/1998 Abe et al. ..... 132/201

* cited by examiner

*Primary Examiner*—John J. Wilson
*Assistant Examiner*—Robyn Kieu Doan
(74) *Attorney, Agent, or Firm*—Ronald E. Greigg

(57) ABSTRACT

A hairpiece for use in hair weaving includes an elongated, braided or plaided carrier strand and means at least at each end portion for attaching the strand to the wearer's head, supports a plurality of hair switches each formed from an elongated lock of hair folded and tied to form a loop at one end. A first support ring is linked through the closed loop and a second carrier ring is linked through the first and second to the carrier strand to provide a freely moving chain-link support for the switches.

13 Claims, 4 Drawing Sheets

HAIRPIECE AND METHOD FOR ATTACHMENT

BACKGROUND OF THE INVENTION

1. Field of the Invention

This invention relates to hair pieces and to their method of use, and more particularly to an improved hair weave device and its method of use to enhance or supplement the wearer's natural hair.

2. Description of the Prior Art

It is known to enhance the apparent bulk or volume of hair by the use of a hairpiece by strategically attaching switches or locks of natural or artificial hair on the wearer's head to be blended in and concealed by the wearer's own natural hair. The process of accomplishing this is generally referred to as weaving. One example of such a hair piece is shown in U.S. Pat. No. 1,351,427 which discloses a thin metal clip or strand shaped to conform to the wearer's head and to be concealed by the wearer's hair. A switch of hair is attached to each end of the clip to hold the switches one on each side of the wearer's head.

U.S. Pat. No. 2,865,380 discloses a hair piece in the form of an elongated thin flexible member or carrier strap with strands of hair attached thereto along its length by sewing or braiding, this device is used by sewing a plurality of the carrier strands to plaits of the wearer's hair in overlapping "weatherboard" fashion.

U.S. Pat. No. 4,600,029 discloses a hair piece in the form of an endless (circular) band having individual hairs adjustably attached thereto to be worn between layers of the natural hair.

U.S. Pat. No. 5,357,986 discloses a hair locking process and device in which a flexible ribbon or thread with rings knotted therealong is woven as, or along with, one strand of a flat braid of the wearer's hair, which braid encircles the crown, or the rear portion of the crown of the head. A machine-stitched sheet-like weft of hair, also having rings attached along the stitched area thereof, is connected to the flat braid by hand sewing the rings of the two components together.

Other devices and techniques are known for supplementing the natural hair or to facilitate styling are known in which small switches of hair are attached to the wearer's head and blended, or woven, into the natural hair. The known device and technique have not been entirely satisfactory, however, for various reasons. For example, the arrangement for attaching the devices frequently have not been sufficiently secure to permit extended wear, particularly during sleep or while swimming, or the like. Further, many of the devices and techniques could not readily be applied by the user alone, and when applied, could not be easily removed without undesired cutting of the natural hair, even when applied and/or removed by professional hairdressers or weavers. Also, the known devices generally have not permitted independent movement of the respective switches of hair to provide a natural look or to permit the desired blending with the wearer's natural hair. It is therefore a primary object of the present invention to provide an improved hair weaving device and technique which overcomes the above deficiencies of the prior art.

A specific object of the invention is to provide an improved hair weaving device which can easily and readily be attached to the wearer's head and which can be worn for extended periods of time.

Another object is to provide such a device and technique in which a plurality of hair switches are separately supported in a manner to permit a more natural blending with the wearer's natural hair and to facilitate freer flowing hair.

Another object is to provide a hair piece that can be applied and removed by the wearer and which gives the appearance of a professional hair weave.

Another object is to provide a hair weaving device and method which can readily be adapted to the individual wearer's head size and styling needs.

Another object is to provide such a hair weaving device and method which can readily be removed without cutting nature hair on the wearer's head.

SUMMARY OF THE INVENTION

The foregoing objects and other features and advantages are accomplished in accordance with the present invention in which individual switches are formed by folding a lock or hank of hair in half, then tying or sewing it near the fold to form a small closed loop. A first small ring is linked through the loop, and a second, preferably slightly larger ring is linked through the first. The second ring is jointed to an elongated carrier strand for attachment to the wearer's head. A plurality of the switches are attached to the carrier strand at spaced intervals therealong. The first ring my be split or cut so that it can be opened to enable the hair loops and the second ring to be inserted therein, then permanently reclosed. Alternatively, the switches of hair may be threaded through the first ring then tied or secure to form the closed loop.

The carrier strands are preferably braided from a plurality of strands of elastic thread, or from a plurality of strands of non-elastic threads of suitable strength for hair weaving. For example, the elastic threads may be braided or plaited together, or a larger number, e.g. nine lengths of non-elastic threads, may be divided into groups and plaited tightly together to form the carrier stand.

A fastening device is attached to the carrier strand at each end, and one or more fastening devices may be attached intermediate the ends, depending on the type of fastener used and the length and type of carrier strand used. The fastener devices may be in the form of small, thin, over-center clamping combs or small sections of a flexible open mesh fabric or screen which may be sewn to the natural hair in button fashion to hold the hairpiece in place on the wearer's head.

To use the hairpiece of the invention, the hair may be parted along a line where it is to be attached, or a corn row of hair may be braided along this line. The thin braided carrier strand is placed along the part or corn row and the fasteners are each attached to firmly hold the hairpiece in place. If snap-locking comb fasteners are used, the individual combs are inserted into the natural hair, teeth pointing downward along the scalp, then the comb is snapped over-center to clamp the comb teeth and hair against the clamping bar of the comb fastener. If the screen-like tab fasteners are used, the carrier strand is positioned as above, and the fastener tabs are sewn to the hair in a button-like fashion, preferably to a corn row, and preferably using a thread which is colored to slightly contrast with the color of the wearer's hair to facilitate removal by cutting the thread without cutting the natural hair.

Once the carrier strand is attached, the wearer's natural hair is combed thereover to cover the carrier and attaching rings. At the same time, the double-ring-loop support of the individual switches permit freer movement for styling with the wearer's natural hair.

The length of the carrier strand may vary, depending on the manner of use. For example, the carrier strand may be attached extending generally ear to ear at the occipital bone, or from front to back, generally from forehead to the nape of the neck. Also the number and spacing of the switches on the carrier strand may be varied and of course a plurality of the hair pieces may be employed in generally parallel rows or as otherwise required to provide the desired fullness or intended style.

BRIEF DESCRIPTION OF THE DRAWINGS

The foregoing and other features and advantages of the invention will become apparent from the detailed description contained herein below, taken with the drawings, in which.

DESCRIPTION OF THE PREFERRED EMBODIMENTS

Figure 1:
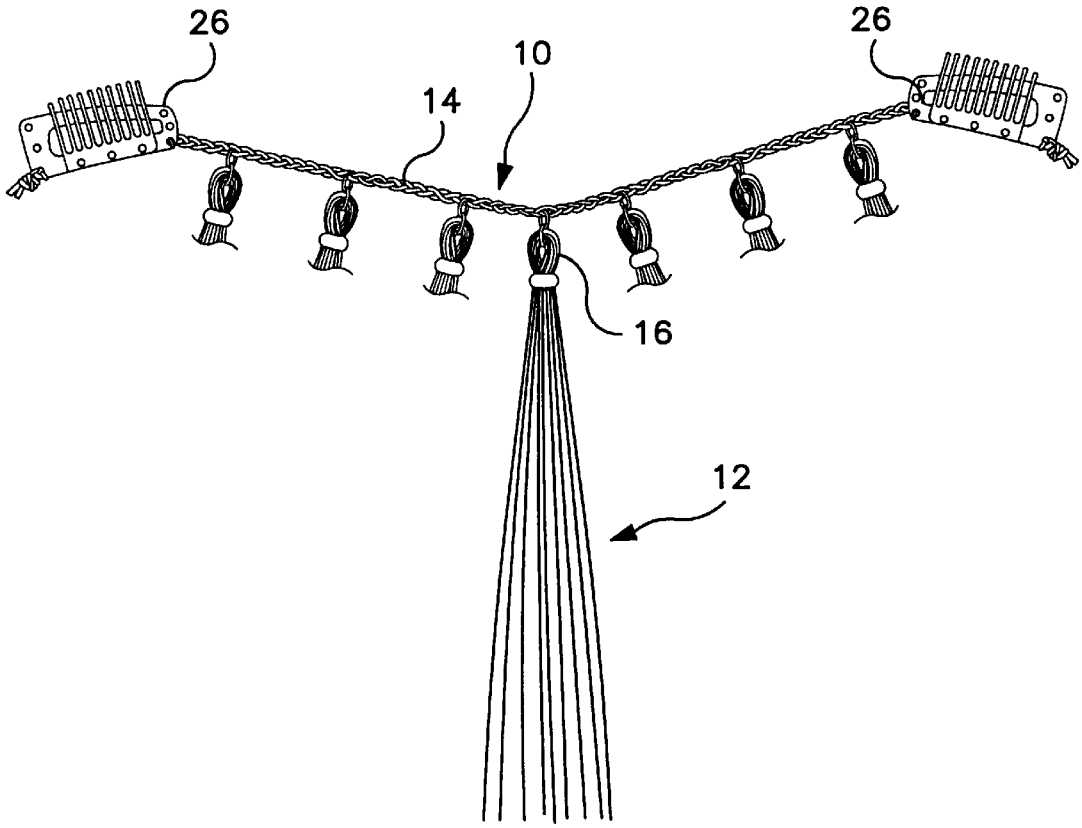
FIG. 1 is a plain view of a hairpiece according to the invention.
Figure 2:
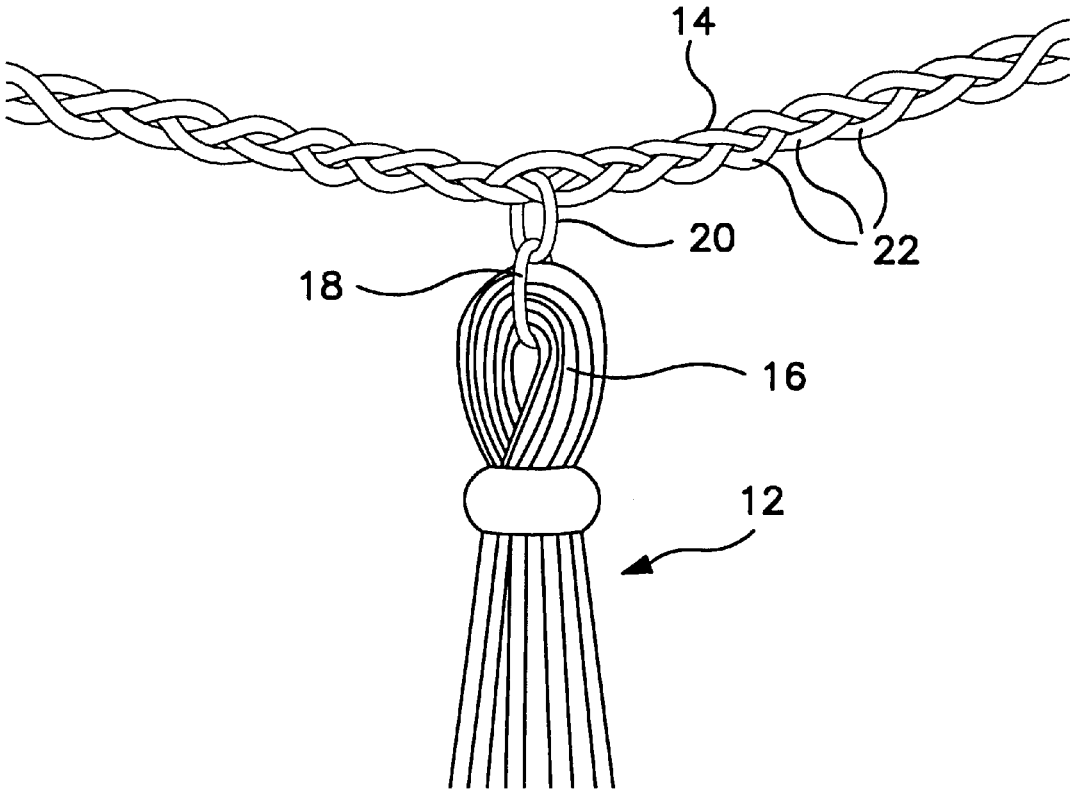
FIG. 2 is an enlarged, fragmentary view of the hairpiece shown in FIG. 1, showing the manner of attaching the individual switches of hair to the carrier strand.

Referring now to the drawings in detail, a hair piece designated generally by the reference number 10 is illustrated in FIG. 1 as including a plurality of switches 12 of hair, preferably natural human hair, supported at spaced intervals along the length of a braided carrier strand 14. The switches 12 are formed from a lock of hair of substantially uniform length folded in the middle and tied closely adjacent the fold to form a closed loop 16. A first mounting ring 18 is linked through the loop 16 of each lock and a second, preferably smaller carrier ring 20 is linked with the first carrier ring 18 and joined to the carrier strand as by passing one or more of the strand threads through the ring to support the individual switches. The carrier rings 18, 20 may be metal or a synthetic resin such as an acrylic material, and the carrier rings 18 may be cut through so that its ends may be separated to receive the loops 16 and the second carrier rings 20, then reclosed to retain the parts assembled. The open loops 16 and the first and second carrier rings 18, 20 cooperate to form a three-link chain-like support permitting freer individual movement of the switches supported on the carrier strand. Preferably, the carrier rings and carrier strand, as well as any tying or sewing thread, is colored so as not to substantially contrast with the color of the hair of the switches 12 which, of course, are preferably colored to correspond as closely as possible to the color of the wearer's natural hair.

The carrier strand 14 is preferably braided, or plaited, so as to be readily flexible and at least slightly elastic or stretchable to thereby easily conform to the wearer's head without producing unsightly bulges beneath the wearer's hair in use. The strand 14 may be braided, for example, from three strands of elastic thread 22. A very pliable, slightly stretchable carrier strand 1 may also be formed from a plurality of strands of non-elastic thread. For example, nine threads may be divided into three equal bundles which are then braided together to form the strand 14. This latter construction is particularly well suited for attaching along a corn row. The threads 22 may be knotted, tied or clamped together at the ends of the carrier strand.

Figure 3:
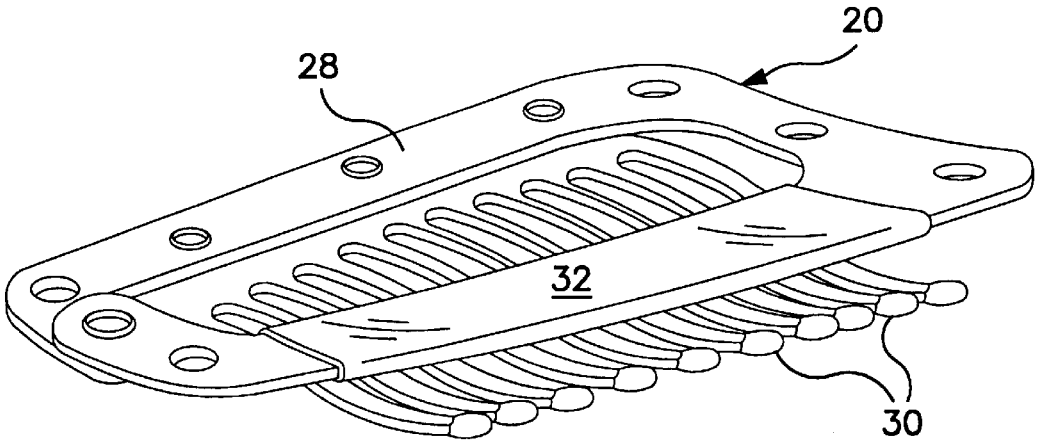
FIG. 3 is an isometric view of an over-center clamping comb useful in attaching the hairpiece to a wearer's head.
Figure 4:
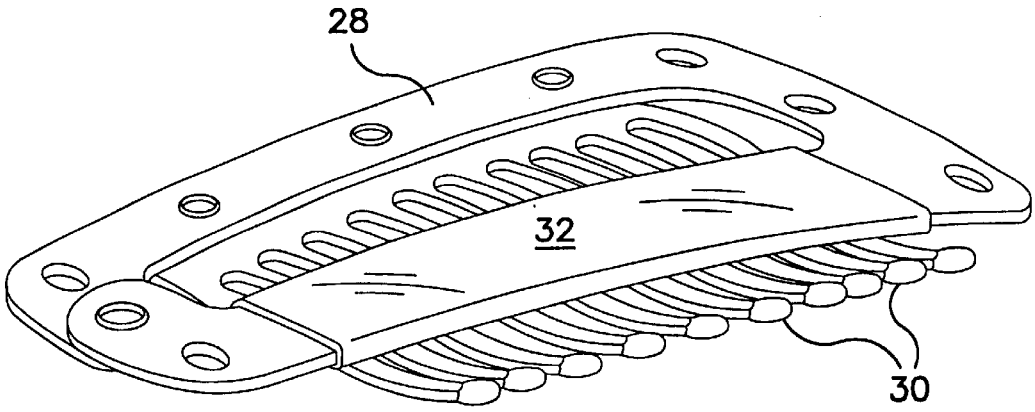
FIG. 4 is a view similar to FIG. 3, showing the comb in the open, non-clamping position.

As seen in FIG. 3, carrier strand 14 has a fastening device attached at least at each end and may have one or more such devices attached intermediate its ends, depending on the length of the carrier strand. The fastening devices may be in the form of a clamping comb 26 as best seen in FIGS. 3 and 4. Clamping combs are known in the hair weaving art and are commercially available. Typically, such combs 26 are formed of a thin metal having a slightly curved base 28 and spaced teeth 30, with a clamping bar 32, preferably having a resilient coating, extending in spaced rotation to the free ends of the teeth in the relaxed state. By pressing the base causing it to snap over-center with relation to the clamping bar, the combing teeth are pressed against the clamping bar and act to retain the back in the reversely curved, or over-center position. Thus, when the hair piece 10 is positioned on the wearer's head, for example along a part extending generally around the back of the head, it is releasibly attached by inserting the comb's teeth downward into the natural hair and snapped over-center to clamp the hair against the clamping bar 32. The natural hair is then combed over the carrier strand 14 and styled with the switches 16. The freer-swinging support of the chain link attachment of the switches to the carrier strand permits freer movement with the wearer's hair, thereby providing a more natural look over a longer period of time. Attaching the second ring 20 to the strand 14 by passing one or more of the threads 26 through the ring during plaiting of the strand 14 enhances the mobility to the linked support. Other means of attaching the ring 20 to the strand be employed; for example, the ring may be tied or sewn to the strand.

Figure 5:
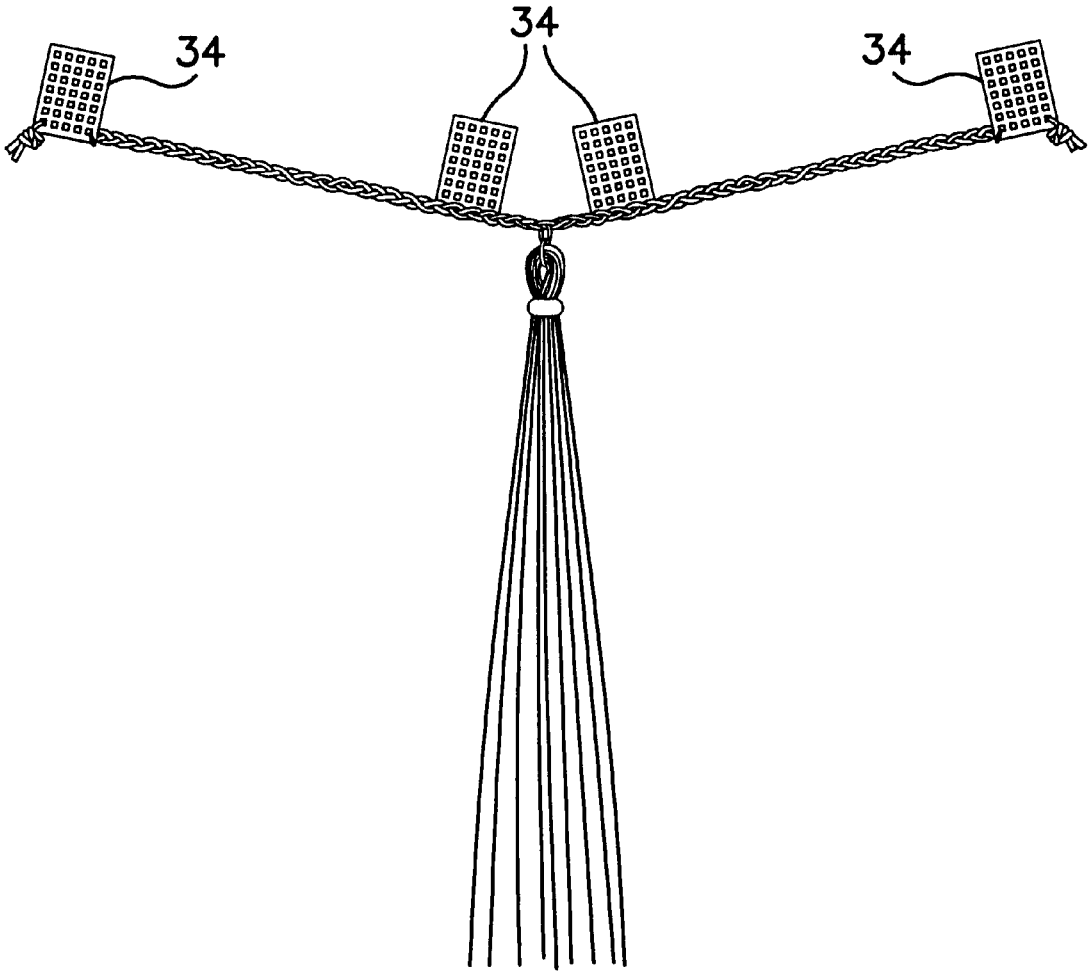
FIG. 5 is a view schematically illustrating an alternate attaching means used to attach the hairpiece to a wearer's head.

In an alternative embodiment shown in FIG. 5, the over-center clamping combs are replaced with small tabs 34 of an open weave, synthetic screen-like flexible material attached, as by sewing to the carrier strand 14 which is braided from non-elastic thread. In this embodiment, the tabs 34 are sewn in a button-like fashion into the natural hair to attach the hairpiece to the wearer's head, for example along a corn row, preferably using a thread which is colored to contrast slightly with the natural hair to facilitate removal of the device by cutting the threads without cutting the natural hair. This embodiment generally is employed for longer term wear, and generally will require assistance, preferably from a hair dresser, for attaching and removing the device.

When plastic support rings 18, 20 are used, they preferably are generally transparent or tinted a color near that of the wearer's natural hair.

While preferred embodiments have been disclosed and described, it should be apparent that the invention is not so limited, but rather it is intended to cover all embodiments which would be apparent to one skilled in the art and which come within the spirit and scope of the invention.

I claim:

1. A hairpiece for use in hair weaving to add hair to the natural hair of a person, said hairpiece comprising, an elongated carrier strand adapted to be secured to the wearer's head, said carrier strand including a plurality of threads braided together and attaching means at least adjacent each end for releasibly attaching the strand to the wearer's natural hair, a plurality of hair switches attached to said carrier strand at spaced intervals therealong, said switches each comprising a lock of hair folded substantially at its midpoint and secured by tying or sewing adjacent the fold to form a small closed loop, a plurality of first support rings interlinked one with each said closed loop, and a plurality of second support rings interlinked one with each said first support ring, said second support rings being attached to said carrier strand at spaced intervals therealong, said closed loop and said first and second support rings cooperating to form a freely movable chain-link support for said switches.

2. The hairpiece defined in claim 1, wherein said carrier strand comprises three elastic threads plaited together to provide a flexible elastic carrier for said switches.

3. The hairpiece defined in claim 1, wherein said carrier strand comprises a plurality of groups of substantially non-elastic threads plaited together whereby said carrier strand is highly flexible and slightly elastic.

4. The hairpiece defined in claim 1, wherein said second support rings are attached to said carrier strand by passing a thread of said carrier strand therethrough.

5. The hairpiece defined in claim 1, wherein said attaching means adjacent each end of said carrier strand comprises an over-center clamping comb.

6. The hairpiece defined in claim 1, wherein said attaching means comprises a flexible open-weave screen-like fabric adapted to be attached to the wearer's natural hair by sewing.

7. The hairpiece defined in claim 1, wherein said first support rings are metal rings.

8. The hairpiece defined in claim 1, wherein at least said first or said second support rings are synthetic resin rings.

9. The hairpiece defined in claim 8, wherein said support rings are formed from an acrylic material.

10. The hairpiece defined in claim 1, wherein said first support ring is larger than said second support ring.

11. A method of hair weaving to supplement the wearer's natural hair, the method comprising, providing a hairpiece including an elongated stretchable carrier strand having attaching means secured thereto at least adjacent each end thereof and a plurality of hair switches attached to the carrier strand at spaced intervals therealong, the switches each including a lock of hair folded substantially at its midpoint and secured by tying or sewing adjacent the fold to form a small closed loop, interlinking a second supporting ring with each first support ring, attaching each second ring to said carrier strand to thereby provide a chain-link support for the hair switches on the carrier strand, parting the wearer's natural hair along a line, placing the carrier strand with the switches attached thereto along the part and securing the hairpiece to the wearer's natural hair over the hairpiece and styling the natural hair and the switches of hairpiece together.

12. The hairpiece defined in claim 11, wherein the carrier strand comprises a plurality of threads, the method including plaiting the plurality of threads to provide a flexible, stretchable strand.

13. The hairpiece defined in claim 12, wherein the plurality of threads are elastic.

* * * * *